US008134519B2

(12) United States Patent
Tominaga

(10) Patent No.: US 8,134,519 B2
(45) Date of Patent: Mar. 13, 2012

(54) CONNECTION STRUCTURE BETWEEN ANTENNA ELEMENT AND COAXIAL CABLE CONNECTOR, AND ANTENNA APPATATUS INCLUDING THE CONNECTION STRUCTURE

(75) Inventor: Yasushi Tominaga, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 423 days.

(21) Appl. No.: 12/358,730

(22) Filed: Jan. 23, 2009

(65) Prior Publication Data

US 2009/0322644 A1 Dec. 31, 2009

(30) Foreign Application Priority Data

Jun. 30, 2008 (JP) ..... 2008-170165

(51) Int. Cl.
*H01Q 1/00* (2006.01)

(52) U.S. Cl. ..... 343/906

(58) Field of Classification Search ..... 343/906; 439/63, 578, 581

See application file for complete search history.

(56) References Cited

U.S. PATENT DOCUMENTS

| | | | |
|---|---|---|---|
| 5,489,912 | A | 2/1996 | Holloway |
| 6,121,935 | A | 9/2000 | Reece et al. |
| 2008/0158047 | A1 | 7/2008 | Tominaga |

FOREIGN PATENT DOCUMENTS

| | | |
|---|---|---|
| JP | 3-267803 | 11/1991 |
| WO | WO 01/37372 A1 | 5/2001 |

*Primary Examiner* — Jacob Y Choi

*Assistant Examiner* — Robert Karacsony

(74) *Attorney, Agent, or Firm* — Oblon, Spivak, McClelland, Maier & Neustadt, L.L.P.

(57) ABSTRACT

A connection structure which electrically connects a connection terminal of an antenna element mounted on a mounting plate to a connection terminal of a coaxial cable connector mounted on the mounting plate, includes a plate-shaped electric connection member which includes an element connection end part electrically connected to the connection terminal of the antenna element and a cable connector connection end part extending away from the element connection end part and having a tapered shape. The connection structure further includes a bar-shaped electric connection member which extends along the cable connector connection end part of the plate-shaped electric connection member and which is electrically connected to the cable connector connection end part. Both the cable connector connection end part of the plate-shaped electric connection member and the bar-shaped electric connection member are electrically connected to the connection terminal of the coaxial cable connector.

6 Claims, 3 Drawing Sheets

CONNECTION STRUCTURE BETWEEN ANTENNA ELEMENT AND COAXIAL CABLE CONNECTOR, AND ANTENNA APPATATUS INCLUDING THE CONNECTION STRUCTURE

CROSS-REFERENCE TO RELATED APPLICATIONS

This application is based upon and claims the benefit of priority from prior Japanese Patent Application No. 2008-170165, filed Jun. 30, 2008, the entire contents of which are incorporated herein by reference.

BACKGROUND OF THE INVENTION

1. Field of the Invention

The present invention relates to a connection structure between an antenna element and a coaxial cable connector, and an antenna apparatus including the connection structure.

2. Description of the Related Art

An antenna apparatus, in which an antenna element is mounted on a mounting plate fixed to an extending end portion of an elongated support whose base portion is fixed to a base, is widely known.

In the antenna apparatus of this kind, a coaxial cable from an antenna control apparatus installed on or outside the base extends from the base portion of the elongated support along the elongated support toward the extending end. And, a coaxial cable connector of the extending end of the coaxial cable is attached to the mounting plate.

A connection terminal of the antenna element and a connection terminal of the coaxial cable connector are electrically connected to each other by connecting both ends of one solid-core conductive line to the connection terminal of the antenna element and the connection terminal of the coaxial cable connector electrically with solder.

The antenna apparatus as described above is used in a DVOR (Doppler VHF Omnidirectional Radio Range) apparatus relating to a radio navigation of aircraft, disclosed in, for example, Japanese Patent Application KOKAI Publication No. 3-267803. The DVOR apparatus includes a disc-shaped radio wave reflection plate which is supported on a base such as a ground or a surface of a building and which is called as a counterpoise, a carrier antenna which is arranged on a center of the radio wave reflection plate, and a plurality of sideband antennas which are arranged on a circle whose center is the carrier antenna on the radio wave reflection plate at equal intervals. The basic structure of each of the sideband antennas is the same as the structure of the above-mentioned antenna apparatus.

Since the DVOR apparatus is installed on out of doors, each of the carrier antenna and sideband antennas is covered with a radome.

When the antenna apparatus which is used out of doors is exposed to strong winds, the elongated support is shook. During this state, the mounting plate which is fixed to the extending end of the elongated support and to which the antenna element is mounted oscillates about the extending end of the elongated support.

When resonance is generated, the oscillation of the extending end of the elongated support becomes large unexpectedly. As a result, unexpectedly repetitive bending is caused in the one solid-core conductive line whose both ends are soldered to the connection terminal of the antenna element and the connection terminal of the coaxial cable connector, and fatigue failure rarely occurs in the one solid-core conductive line.

BRIEF SUMMARY OF THE INVENTION

According to one aspect of the present invention, a connection structure which electrically connects a connection terminal of an antenna element mounted on a mounting plate to a connection terminal of a coaxial cable connector mounted on the mounting plate, comprises: a plate-shaped electric connection member which is made of a plate-shaped conductive material, and which includes an element connection end part electrically connected to the connection terminal of the antenna element and a cable connector connection end part extending away from the element connection end part and having a tapered shape; and a bar-shaped electric connection member which is made of a bar-shaped conductive material, which extends along the cable connector connection end part of the plate-shaped electric connection member, and which is electrically connected to the cable connector connection end part. Further, both the cable connector connection end part of the plate-shaped electric connection member and the bar-shaped electric connection member are electrically connected to the connection terminal of the coaxial cable connector.

According to another aspect of the present invention, an antenna apparatus comprises: a base; an elongated support which has a base portion fixed to the base and an extending end portion extending away from the base; a mounting plate fixed to the extending end portion of the elongated support; a coaxial cable connector which is mounted on the mounting plate and which has a connection terminal; an antenna element which is mounted on the mounting plate and which has a connection terminal; a plate-shaped electric connection member which is made of a plate-shaped conductive material, and which includes an element connection end part electrically connected to the connection terminal of the antenna element and a cable connector connection end part extending away from the element connection end part and having a tapered shape; and a bar-shaped electric connection member which is made of a bar-shaped conductive material, which extends along the cable connector connection end part of the plate-shaped electric connection member, and which is electrically connected to the cable connector connection end part. Further, both the cable connector connection end part of the plate-shaped electric connection member and the bar-shaped electric connection member are electrically connected to the connection terminal of the coaxial cable connector.

BRIEF DESCRIPTION OF THE SEVERAL VIEWS OF THE DRAWINGS

The accompanying drawings, which are incorporated in and constitute a part of the specification, illustrate one embodiment of the invention, and together with the general description given above and the detailed description of the embodiment given below, serve to explain the principles of the invention.

DETAILED DESCRIPTION OF THE INVENTION

Figure 1:
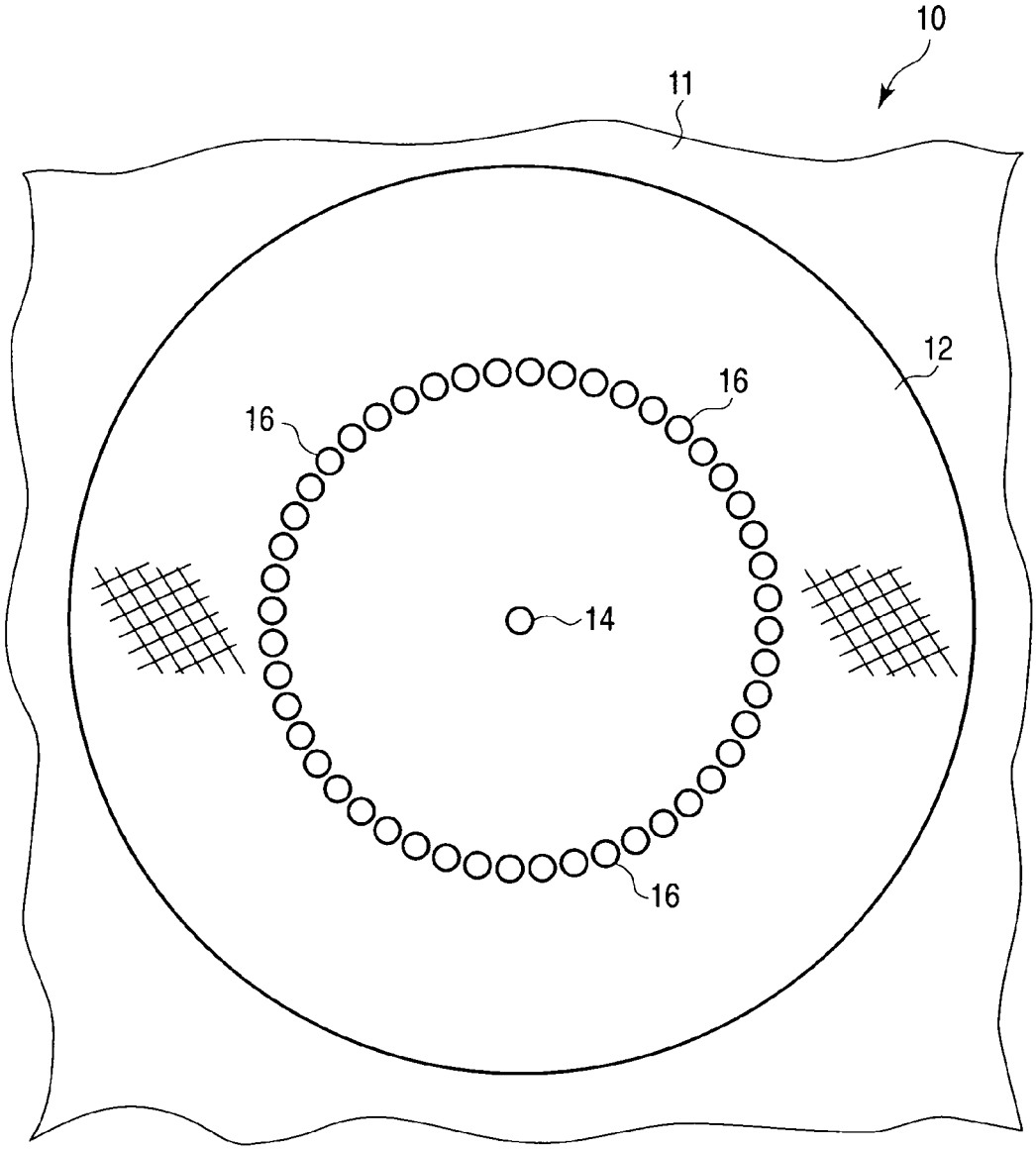
FIG. 1 is a schematic plan view of a DVOR apparatus including a plurality of antenna apparatuses, each using a connection structure between an antenna element and a coaxial cable connector, and the connection structure according to one embodiment of the present invention.

FIG. 1 is a plan view schematically showing a DVOR (Doppler VHF Omnidirectional Radio Range) apparatus 10 including an antenna apparatus using a connection structure between an antenna element and a coaxial cable, the connection structure according to one embodiment of the present invention. The DVOR apparatus 10 is a facility for a radio navigation of aircraft. Since the entire structure and operation of the DVOR apparatus 10 are well known, they are not described in detail.

The DVOR apparatus 10 includes a disc-shaped radio wave reflection plate 12 with a diameter of about 30 m. The disc-shaped radio wave reflection plate 12 is called as a counterpoise supported on a base 11 such as, for example a ground or a surface of a building. A carrier antenna 14 is arranged at a center of the radio wave reflection plate 12, and a plurality of sideband antennas 16 are arranged on a circle of about 6.7 m whose center is the carrier antenna 14 on the radio wave reflection plate 12 at equal intervals.

Operations of the carrier antenna 14 and the plurality of sideband antennas 16 are controlled by an antenna control apparatus not shown and installed on the base 11 or outside the base 11 through a coaxial cable.

The carrier antenna 14 transmits an RF (Radio Frequency) signal (a half-wave SIN signal or a half-wave COS signal) of a predetermined phase omnidirectionally. The plurality of sideband antennas 16 sequentially transmits RF signals of different phases at predetermined timing.

Aircraft receives the RF signal, transmitted from the carrier antenna 14 of the DVOR apparatus 10, and the plural RF signals, sequentially transmitted from the plural sideband antennas 16, by a receiver, so that the aircraft can acquire a direction of the DVOR apparatus 10.

Each of the plurality of sideband antennas 16 provides an antenna apparatus using the connection structure according to one embodiment of the present invention.

Figure 2:
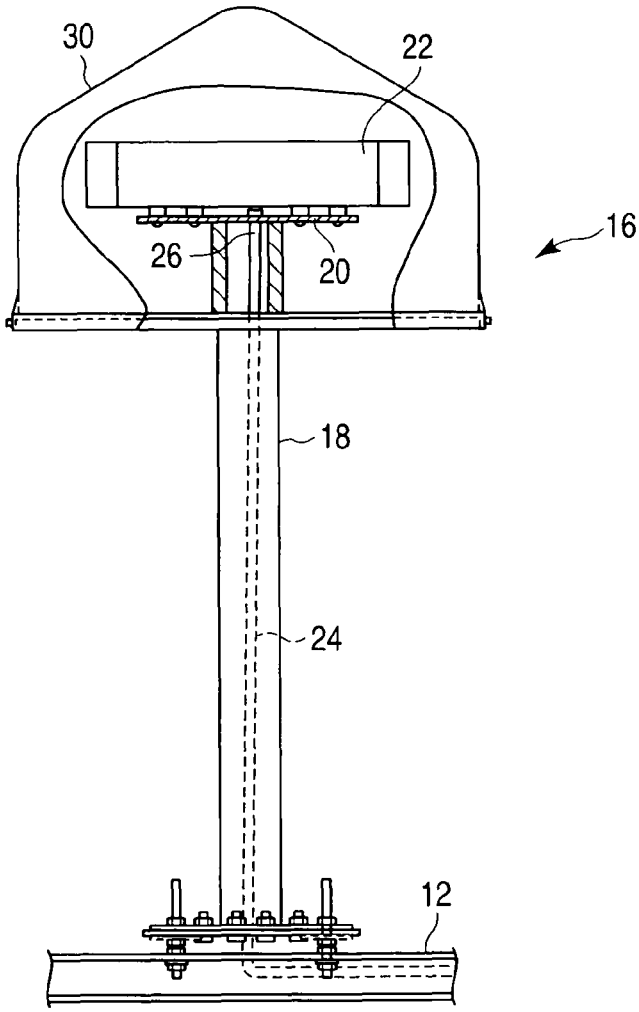
FIG. 2 is a schematic side view of one of the antenna apparatuses included in the DVOR apparatus shown in FIG. 1.

As shown in FIG. 2, the sideband antenna 16 includes an elongated support 18 whose base portion is fixed to the base 11 (see FIG. 1) through the radio wave reflection plate 12. A mounting plate 20 is fixed to an extending end of the elongated support 18.

Figure 3:
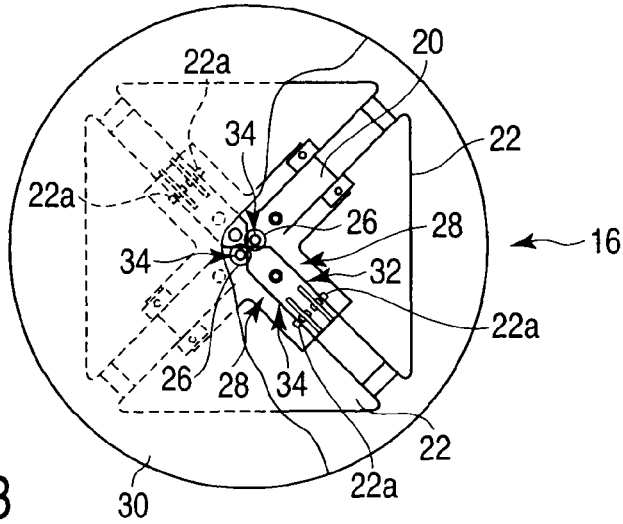
FIG. 3 is a schematic plan view of the antenna apparatus shown in FIG. 2, where a radome is partially cutout.

As shown in FIGS. 2 and 3, a pair of antenna elements 22 and a pair of coaxial cable connectors 26 are mounted on the mounting plate 20. The pair of the coaxial cable connectors 26 is the extending ends of a pair of coaxial cables 24 (FIG. 2 illustrates only one) extending from the antenna control apparatus, not shown, through the radio wave reflection plate 12 and the elongated support 18. The antenna control apparatus, not shown, controls an operation of the pair of antenna elements 22 through the pair of coaxial cables 24.

Each of the antenna elements 22 has a planar shape such that respective apexes of two triangles are opposed to each other (or an angled 8 shape or a closed Z shape in the planar shape).

Figure 4:
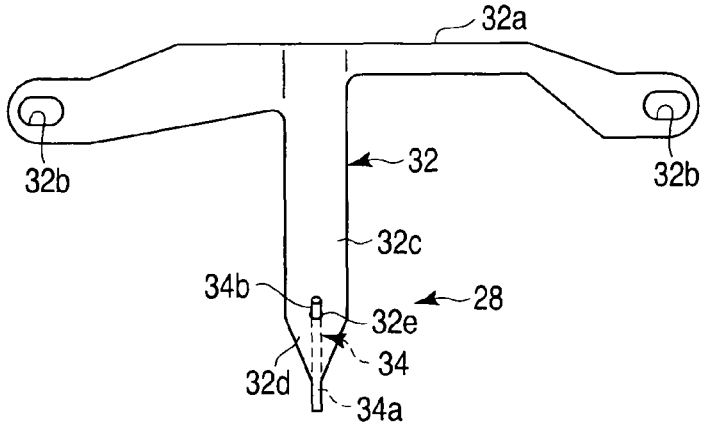
FIG. 4 is a front view schematically showing a combination of a plate-shaped electric connection member and a bar-shaped electric connection member, both of which is included in the connection structure according to one embodiment of the present invention used in the antenna apparatus shown in FIGS. 2 and 3.

Each of the coaxial cable connectors 26 has a center connection terminal shown in FIGS. 4 and 5 and a circular connection terminal which is not shown and which encircles the center connection terminal 26*a*. The circular connection terminal of each coaxial cable connector 26 is electrically connected to wirings on each of circuit boards for the antenna elements 22 supported by the mounting plate 20. And, the center connection terminal 26*a* is connected to a connection terminal 22*a* on one side of each of the two triangles of the antenna element 22 corresponding thereto by the connection structure 28 according to one embodiment of the present invention.

The mounting plate 20 fixed to the extending end of the elongated support 18, the pair of antenna elements 22 mounted on the mounting plate 20, the pair of coaxial cable connectors 26 and the connection structures 28 are covered with a radome 30.

Figure 5A:
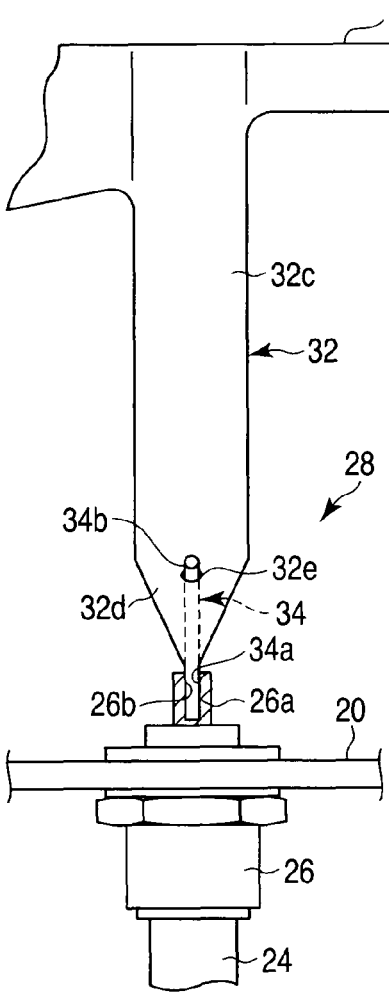
FIG. 5A is a front view schematically showing a state in which the combination of the plate-shaped electric connection member and the bar-shaped electric connection member in the connection structure according to one embodiment of the present invention is electrically connected to a connection terminal of a coaxial cable connector in the antenna apparatus shown in FIGS. 2 and 3.
Figure 5B:
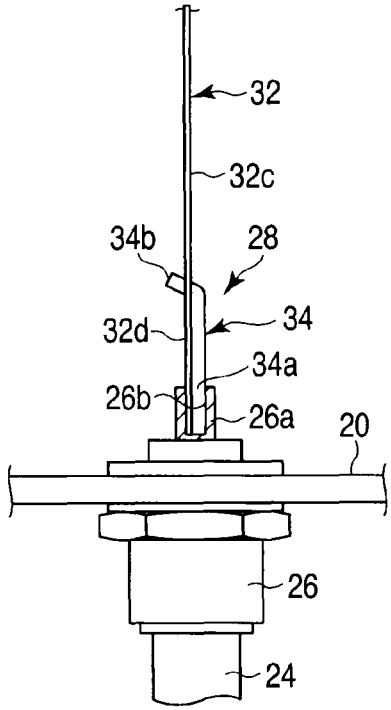
FIG. 5B is a side view schematically showing a state in which the combination of the plate-shaped electric connection member and the bar-shaped electric connection member in the connection structure according to one embodiment of the present invention is electrically connected to the connection terminal of the coaxial cable connector in the antenna apparatus shown in FIGS. 2 and 3.

As shown in FIGS. 4, 5A and 5B, the connection structure 28 includes a plate-shaped electric connection member 32 and a bar-shaped electric connection member 34. The plate-shaped electric connection member 32 is made of a plate-shaped electrically conductive material. The bar-shaped electric connection member 34 is made of a bar-shaped electrically conductive material and is electrically connected to the plate-shaped electric connection member 32.

In this embodiment, the plate-shaped electric connection member 32 is formed from the electrically conductive material such as copper into an approximately T shape, and is plated with a corrosion-resistant substance. In the plate-shaped electric connection member 32, a first part extended in a horizontal direction in FIG. 4 provides an element connection end part 32*a* both end portions of which are electrically connected to the connection terminals 22*a* on one sides of the two triangles of the antenna elements 22. A fixing element through hole 32*b* into which a fixing element, not shown, such as a fixing screw or a fixing pin made of an electrically conductive material is inserted is formed in each of the both end portions of the element connection end part 32*a*. The element connection end part 32*a* of the plate-shaped electric connection member 32 is electrically connected to the connection terminals 22*a* on one sides of the two triangles of the antenna elements 22 by the electrically conductive fixing elements, not shown, which are inserted into the fixing element through holes 32*b* in both end portions of the element connection end part 32*a* of the plate-shaped electric connection member 32.

In the plate-shaped electric connection member 32, a second part extends downward in FIG. 4 from an approximately center of the first portion (element connection end part 32*a*) extending in the horizontal direction in FIG. 4 and provides a cable connector connection end part 32*c* to be electrically connected to the center connection terminal 26*a* of the corresponding coaxial cable connector 26. In the cable connector connection end part 32*c*, a distal end portion 32*d* distant from the element connection end part 32*a* is formed into a tapered shape. Further, in the cable connector connection end part 32*c*, a positioning hole 32*e* is formed at a position distant from the distal end portion 32*d* toward the element connection end part 32*a*.

The bar-shaped electric connection member 34 is formed of an electrical conductive material such as copper, and includes one end portion 34*a* adjacent to the distal end portion 32*d* of the cable connector connection end part 32*c* of the plate-shaped electric connection member 32 and the other end portion 34*b* distant from the distal end portion 32*d*. The positioning of the bar-shaped electric connection member 34 with respect to the distal end portion 32*d* of the cable connector connection end part 32*c* is performed by inserting the other end portion 34*b* into a positioning hole 32*e* formed at the distal end portion 32*d* of the cable connector connection end part 32*c* of the plate-shaped electric connection member 32. The bar-shaped electric connection member 34 is electrically connected to the distal end portion 32*d* of the cable connector connection end part 32*c* by a conductive fixing element such as solder with the one end portion 34*a* being adjacent to the distal end portion 32*d* of the cable connector connection end part 32*c* of the plate-shaped electric connection member 32.

The center connection terminal 26*a* of the coaxial cable connector 26 has a connection hole 26*b* opened at its extending end. The tapered distal end portion 32*d* of the cable connector connection end part 32*c* of the plate-shaped electric connection member 32 and the one end portion 34*a* of the bar-shaped electric connection member 34 integrated with the distal end portion 32*d* are tightly inserted into the connection hole 26*b*. As a result, the electric connection of the connection terminals 22*a* of the antenna elements 20 to the center connection terminal 26*a* of the coaxial cable connector 26 are performed by the connection structure 28 including the plate-shaped electric connection member 32 and the bar-shaped electric connection member 34. Further, the tapered distal end portion 32*d* of the cable connector connection end part 32*c* of the plate-shaped electric connection member 32 and the one end portion 34*a* of the bar-shaped electric connection member 34 are fixed to the center connection terminal 26*a* of the coaxial cable connector 26 by a conductive fixing element such as solder.

The combination of the tapered distal end portion 32*d* of the cable connector connection end part 32*c* of the plate-shaped electric connection member 32 and the one end portion 34*a* of the bar-shaped electric connection member 34, which is tightly inserted into the connection hole 26*b* of the center connection terminal 26*a* of the coaxial cable connector 26, provides a desired current capacity and impedance matching between the center connection terminal 26*a* of the coaxial cable connector 26 and the corresponding antenna element 22.

The above mentioned combination of the connection structure 28 does not cause the conventional fatigue failure in the connection between the connection terminal 22*a* of the antenna element 22 and the center connection terminal 26*a* of the coaxial cable connector 26 even when unexpected repetitive bending is applied to the connection.

According to the concept of the present invention, the plate-shaped electric connection member 32 can be formed of an electrically conductive plastic material. Further, the antenna apparatus using the connection structure 28 between the antenna element 22 and the coaxial cable connector 26, according to one embodiment of the present invention, can be the carrier antenna 14 of the DVOR apparatus 10.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A connection structure which electrically connects a connection terminal of an antenna element mounted on a mounting plate to a connection terminal of a coaxial cable connector mounted on the mounting plate, comprising:

a planar electric connection member which is made of a planar conductive material, and which includes a planar element connection end part electrically connected to the connection terminal of the antenna element and a planar cable connector connection end part extending away from the planar element connection end part and having a taper-shaped distal end portion with an elongated tip; and a bar-shaped electric connection member which is made of a bar-shaped conductive material, which extends along the planar cable connector connection end part of the planar electric connection member, and which is electrically connected to the planar cable connector connection end part, wherein the bar-shaped electric connection member has one end portion adjacent to the elongated tip of the taper-shaped distal end portion and the other end portion distant from the one end portion and adjacent to the taper-shaped distal end portion of the planar cable connector connection end part of the planar electric connection member, and the connection terminal of the coaxial cable connector has a connection hole into which the elongated tip of the taper-shaped distal end portion of the planar cable connector connection end part of the planar electric connection member and the one end portion of the bar-shaped electric connection member are inserted, and wherein both the planar cable connector connection end part of the planar electric connection member and the bar-shaped electric connection member are electrically connected to the connection terminal of the coaxial cable connector.

2. The connection structure according to claim 1, wherein the planar cable connector connection end part of the planar electric connection member has a positioning hole at a position distant from the elongated tip of the taper-shaped distal end portion, the positioning hole receiving and positioning the other end portion of the bar-shaped electric connection member.

3. An antenna apparatus comprising:

a base;

an elongated support which has a base portion fixed to the base and an extending end portion extending away from the base;

a mounting plate fixed to the extending end portion of the elongated support;

a coaxial cable connector which is mounted on the mounting plate and which has a connection terminal;

an antenna element which is mounted on the mounting plate and which has a connection terminal;

a planar electric connection member which is made of a planar conductive material, and which includes a planar element connection end part electrically connected to the connection terminal of the antenna element and a planar cable connector connection end part extending away from the planar element connection end part and having a taper-shaped distal end portion with an elongated tip; and a bar-shaped electric connection member which is made of a bar-shaped conductive material, which extends along the planar cable connector connection end part of the planar electric connection member, and which is electrically connected to the planar cable connector connection end part, wherein the bar-shaped electric connection member has one end portion adjacent to the elongated tip of the taper-shaped distal end portion and the other end portion distant from the one end portion and adjacent to the taper-shaped distal end portion of the planar cable connector connection end part of the planar electric connection member, and the connection terminal of the coaxial cable connector has a connection hole into which the elongated tip of the taper-shaped distal end portion of the planar cable connector connection end part of the planar electric connection member and the one end portion of the bar-shaped electric connection member are inserted, and wherein both the planar cable connector connection end part of the planar electric connection member and the bar-shaped electric connection member are electrically connected to the connection terminal of the coaxial cable connector.

4. The antenna apparatus according to claim 3, wherein the planar cable connector connection end part of the planar electric connection member has a positioning hole at a position distant from the elongated tip of the taper-shaped distal end portion, the positioning hole receiving and positioning the other end portion of the bar-shaped electric connection member.

5. The antenna apparatus according to claim 3, further comprising a radome which covers the mounting plate as well as the coaxial cable connector, the antenna element, the planar electric connection member and the bar-shaped electric connection member.

6. The antenna apparatus according to claim 3, wherein the antenna apparatus is configured as at least one of a carrier antenna and a plurality of sideband antennas, used in a DVOR apparatus.

* * * * *